United States Patent [19]

Klahn et al.

[11] Patent Number: 4,757,785

[45] Date of Patent: Jul. 19, 1988

[54] STEAM GENERATOR SLUDGE REMOVAL APPARATUS

[75] Inventors: Francis C. Klahn, Huddleston; Bruce W. Schafer; Charles E. Werner, both of Lynchburg, all of Va.

[73] Assignee: The Babcock & Wilcox Company, New Orleans, La.

[21] Appl. No.: 16,682

[22] Filed: Feb. 19, 1987

[51] Int. Cl.[4] ..... F28G 1/16

[52] U.S. Cl. ..... 122/382; 122/390; 122/405; 134/167 R; 134/181; 165/95; 376/310

[58] Field of Search ..... 122/379, 380, 382, 383, 122/388, 390, 392, 405; 15/316 R, 317; 134/167 R, 166 R, 172, 180, 181; 165/95, 11.2; 376/249, 250, 310, 316

[56] References Cited

U.S. PATENT DOCUMENTS

| | | | |
|---|---|---|---|
| 2,604,358 | 7/1952 | Richards | 15/317 X |
| 3,344,459 | 10/1967 | Jankowski | 122/392 X |
| 4,079,701 | 3/1978 | Hickman et al. | 122/405 X |
| 4,424,769 | 1/1984 | Charamathieu et al. | 122/392 X |
| 4,436,694 | 3/1984 | Vassalotti et al. | 376/310 |
| 4,515,747 | 5/1985 | Creek et al. | 376/249 |
| 4,569,230 | 2/1986 | Asly et al. | 376/249 X |

*Primary Examiner*—Steven E. Warner

*Attorney, Agent, or Firm*—Robert J. Edwards; D. Neil LaHaye

[57] ABSTRACT

A lance assembly designed to clean sludge from the portion of the OTSG tube bundle which is inaccessible from the open tube lane. A track assembled between the OTSG outer shell and circular shroud around the tube bundle substantially opposite the open tube lane has a motorized carriage driven on the track which directs high pressure fluid through a plurality of nozzles toward the tube bundle through windows in the circular shroud. The nozzles are attached to a nozzle block which is capable of being moved vertically on the carriage to vary the flow impact area on the tube bundle.

3 Claims, 5 Drawing Sheets

STEAM GENERATOR SLUDGE REMOVAL APPARATUS

BACKGROUND OF THE INVENTON

Field of the Invention

The present invention relates to equipment for cleaning steam generators and in particular to a high pressure fluid lance for cleaning sludge off the steam generator tubes away from an open tube lane.

General Background

In nuclear power stations, steam generators such as once-through steam generators (OTSG's) are used for heat exchange purposes in the generation of steam for driving turbines. Primary fluid which is heated by the core of the nuclear reactor is lead through a collection or bundle of tubes in the OTSG. A secondary fluid, generally water, which is fed into the space around the tubes receives heat from the tubes to provide a continuous steam generation cycle. Due to the constant high temperature and severe operating environment, a sludge mainly comprised of an iron oxide such as magnetite builds up on the lower outer portion of the tubes and on the upper and lower tube sheets which support the tube bundle. As the sludge build-up on the tube bundle and tube sheets reduces the heat transfer efficiency of the tubes and can cause corrosion, it is preferable that the tubes and tube sheets be periodically cleaned to remove the sludge.

Sludge lancing of OTSG's has traditionally been performed by introducing a lance down the open tube lane to inject water between the tubes. The open tube lane provided extends only one-half the distance through the tube bundle and the tubes are arranged in a triangular pitch. This results in the operator of the lance being able to access only two-thirds of the tube bundle by the traditional lancing method.

SUMMARY OF THE INVENTION

The present invention solves the aforementioned problem in a straightforward manner. What is provided is a lance assembly designed to clean sludge from the portion of the tube bundle inaccessible to lancing from the open tube lane. The assembly injects a plurality of jets of high pressure water between the tubes in the normally inaccessible region of the tube bundle and moves the sludge toward the more accessible region where a lance wand used in the open tube lane can be used to cause removal of the sludge from the OTSG. A track having a plurality of sections is inserted through a manway one section at a time. The sections are assembled together as a unit and rest on the lower tube sheet between the OTSG shell and a circular shroud which surrounds the tube bundle. A remotely controlled carriage assembly placed on the track directs high pressure cleaning fluid at the tube bundle through windows in the shroud as the carriage assembly is driven along the track by a sprocket and chain drive. A plurality of nozzles are mounted on a nozzle block which is attached to the carriage assembly so as to be vertically adjustable so that the flow impact area on the tube bundle and in lanes between tubes may be advantageously varied for a more efficient cleaning action.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
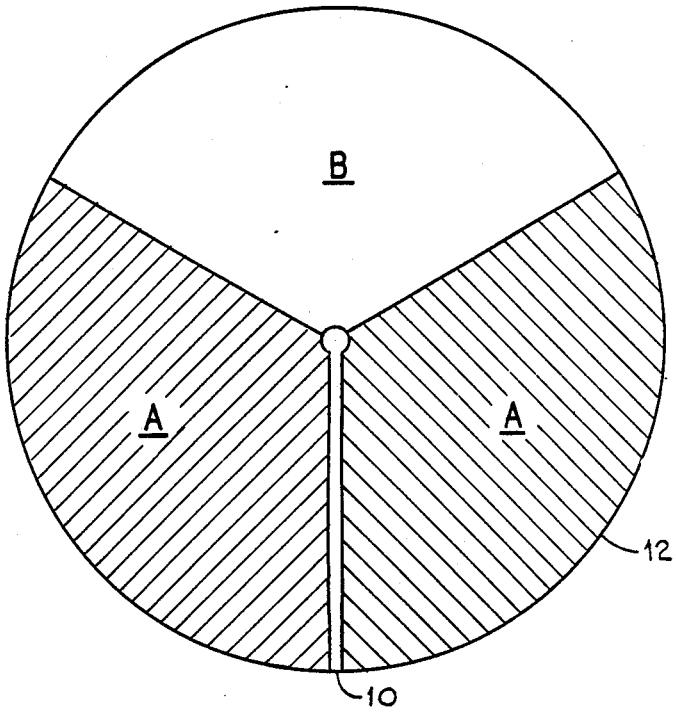
FIG. 1 is a schematic view illustrating the tube bundle and open tube lane.
Figure 2:
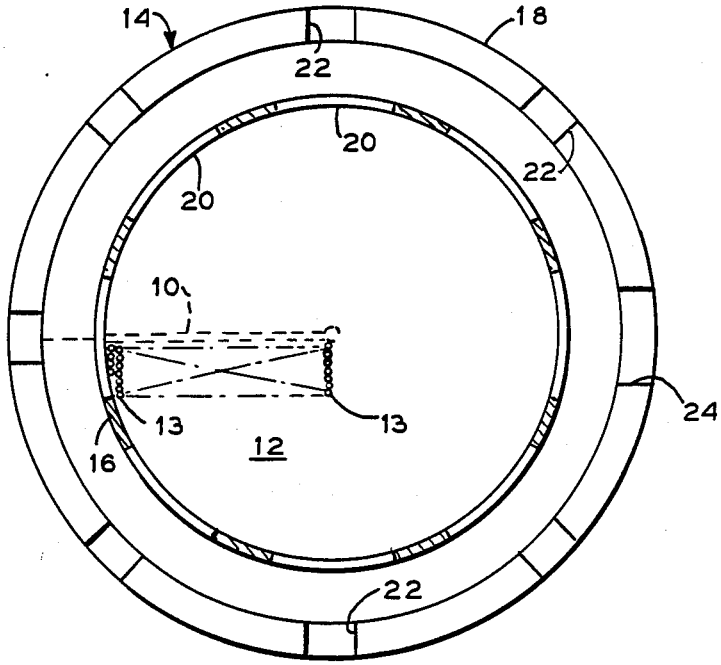
FIG. 2 is a top sectional view of a once-through steam generator.

Referring to the drawings, it is seen in the schematic of FIG. 1 that open tube lane 10 provides for easy access to area A of tube bundle 12 but no access to area B by a lance wand which would be used in open tube lane 10. As seen in the top sectional view of FIG. 2, once-through steam generator 14 is comprised of tube bundle 12 (with only some of tubes 13 being shown for ease of illustration), circular shroud 16 which surrounds tube bundle 12, and outer shell 18. Shroud 16 is provided with eight (8) 30 degree wide "window" openings 20 at approximately every 45 degrees. Outer shell 18 is provided with one sixteen (16) inch diameter manway 24 opposite open tube lane 10 (indicated by the dashed line in FIG. 2) and seven five (5) inch diameter handholes 22 at all of the remaining 45 degree increments.

Figure 3:
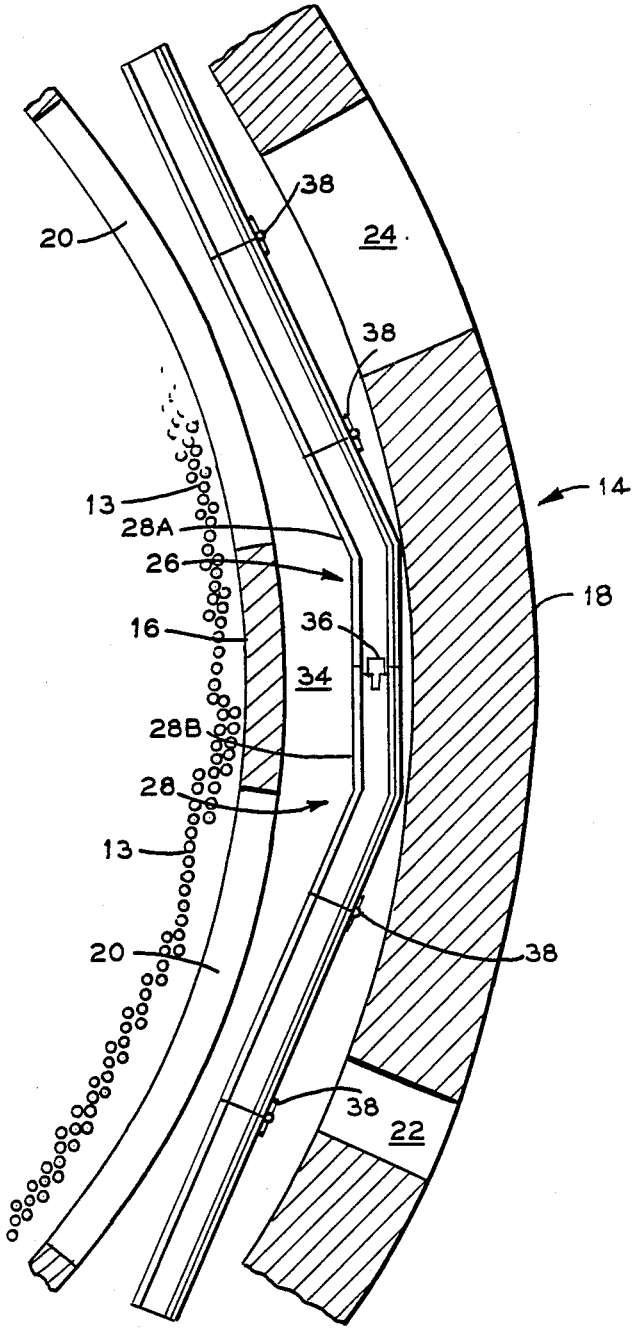
FIG. 3 is a detailed view illustrating the track of the invention installed between the outer shell and circular shroud.
Figure 4:
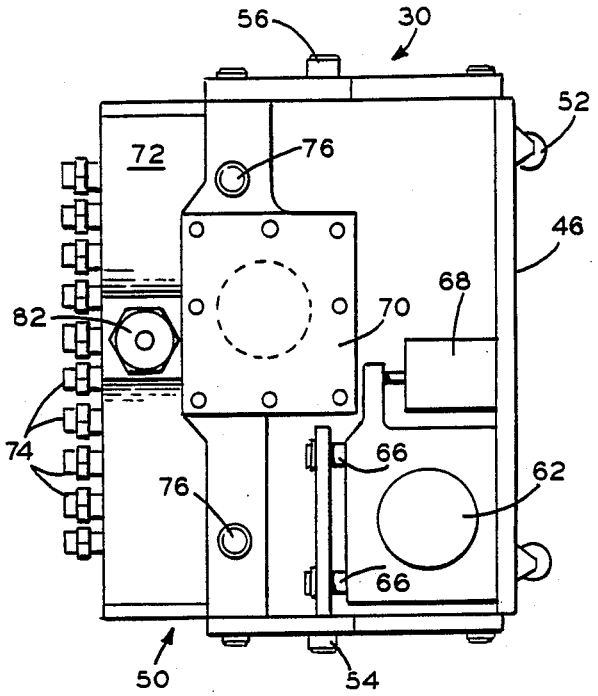
FIG. 4 is a top view of the carriage assembly.
Figure 5:
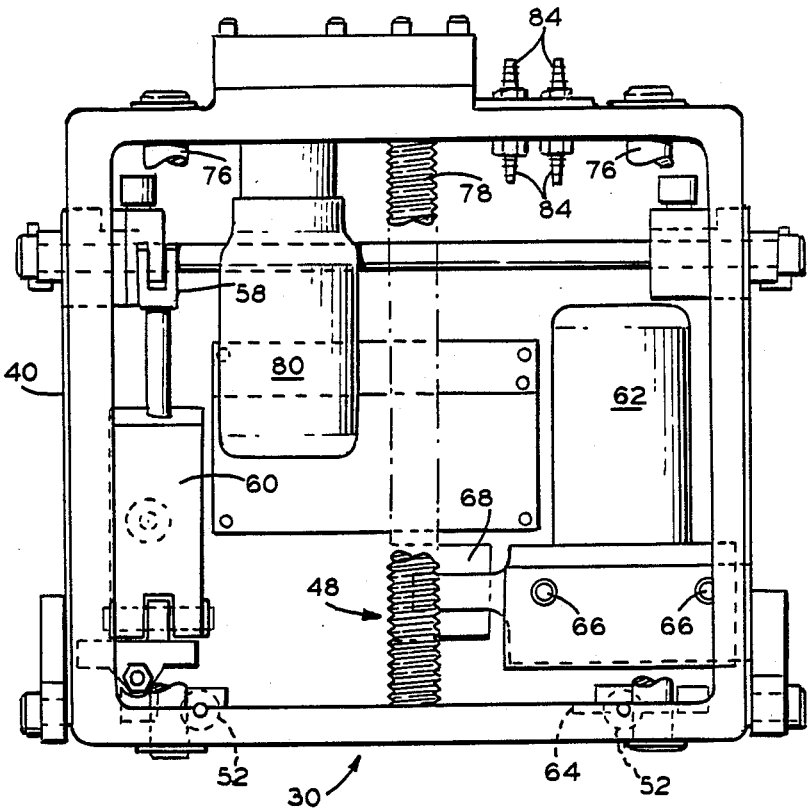
FIG. 5 is a back view of the carriage assembly.

As seen in FIGS. 3–5, the invention is generally referred to by the numeral 26. Lance assembly 26 is generally comprised of track 28, carriage assembly 30, and spray means 50.

As best seen in FIG. 3, track 28 is formed from a plurality of sections which are assembled together inside steam generator 14 between outer shell 18 and circular shroud 16 and rests on lower tube sheet 34. In the preferred embodiment, track 28 is formed from two main assemblies **28*a*, b of three sections each. Main assemblies 28*a*, b are held together by latch 36 which may be formed from any suitable type known in the art. The three sections of each assembly are hinged together at point 38 as indicated to allow easy insertion and removal through manway 24. Drive means is mounted on track 28 and carriage assembly 30 for causing movement of carriage assembly 30 along track 28** during lancing operations.

Figure 7:
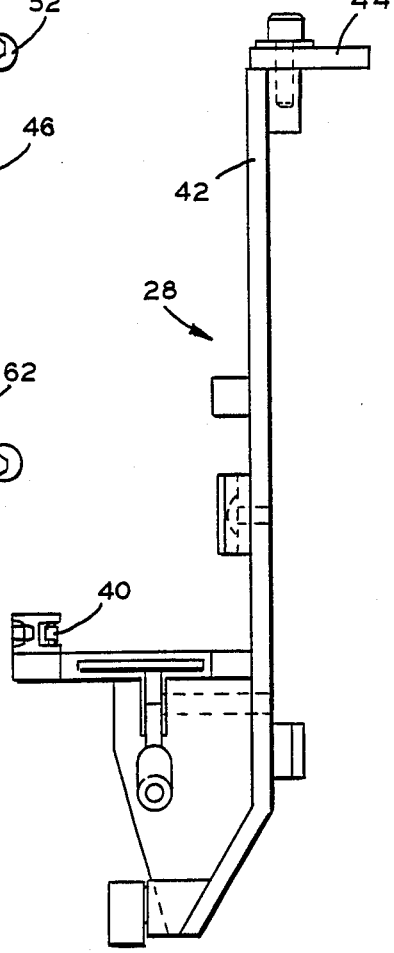
FIG. 7 is a side sectional view of the track.

As best seen in FIG. 7, each section of track 28 is provided with chain 40 mounted in one sidewall. Chain 40 is mounted in a stationary position in the sidewall of track 28 to provide a continuous driving surface for engagement with the drive means on carriage assembly 30. Track 28 has sidewall 42 opposite that in which chain 40 is mounted formed as a higher wall which provides support to carriage assembly 30 during cleaning operations and also serves to support engagement between chain 40 and the drive means of carriage assembly 30. Track 28 is also provided with means for retaining it in its installed position relative to its radial distance from circular shroud 16. A plurality of stops in the form of a manually adjustable cam 44, only one being shown for ease of illustration, are positioned along the outer wall of track 28 so as to contact the inner surface of outer shell 18. Stops may also be provided on the opposite side of track 28 adjacent hinges 38 which engage either a ring on the tubesheet or circular shroud 16 to insure that the sections remain locked open in their operating position.

Figure 6:
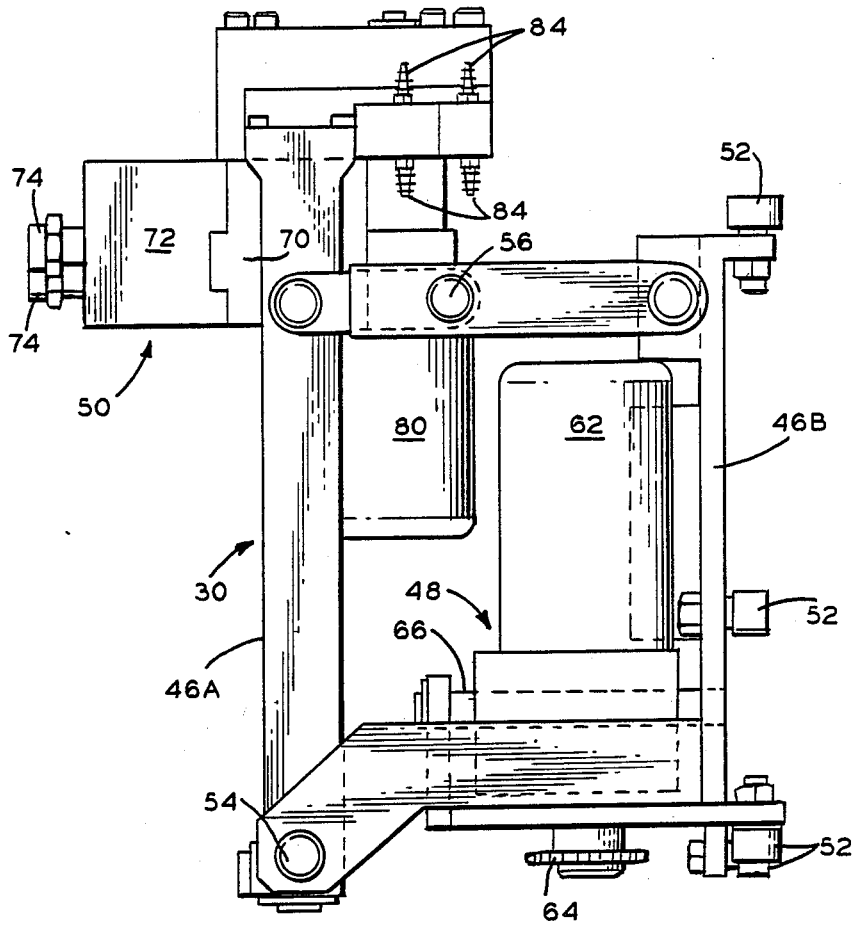
FIG. 6 is a side view of the carriage assembly.

Carriage assembly 30, best seen in FIGS. 4–6, is generally comprised of frame 46, drive means 48 and spray means 50. Frame 46 is provided with a plurality of roller bearings 52 which contact track 28 during operation to reduce friction between carriage assembly 30 and track 28. Frame 46 is provided with a first frame section **46*a* which pivots between a first installation position and a second operating position. First frame section 46*a* is pivotally mounted at its lower end to second frame section 46*b* at point 54 and at its upper end at point 56 so as to pivot toward second frame section 46*b* for ease of installation through manway 24. Once in position, first frame section 46*a* is caused to pivot into its second operating position by bell crank 58. Bell crank 58 is powered by air cylinder 60 mounted on second frame section 46*b*. Drive means 48 is mounted in second frame section 46*b* and comprised of motor 62 and sprocket 64 which is attached thereto. Motor 62 is slidably mounted on rails 66 so as to be movable between a first inoperative position and a second operative position wherein sprocket 64 engages chain 40. Movement between the two positions is caused by air cylinder 68 which is attached thereto. Spray means 50 is slidably mounted on first frame section 46*a* for vertical movement thereon and comprised of base 70, nozzle block 72, and nozzles 74. Base 70 is slidably mounted on guide bars 76 and threadably engaged on screw drive 78. Motor 80 is mounted on base 70 and engaged with screw drive 78 to cause rotation thereof. In this manner, base 70 and nozzle block 72 are caused to move vertically either up or down in response to rotation of screw drive 78. A plurality of nozzles 74 are provided on nozzle block 72 for directing high pressure fluid toward the tube bundle. Cleaning fluid is supplied to nozzle block 72 through fluid supply line 82 which receives high pressure fluid from a source not shown. Air hose fittings 84 are provided on first frame section 46*a* for supplying compressed air from a source not shown to air cylinders 60 and 68**.

In operation, track sections **28*a* and *b* are inserted through manway 24, unfolded, and latched together in position such that the straight sections are aligned with window openings 20 as illustrated in FIG. 3. Carriage assembly 30 is then inserted through manway 24 and positioned on track 28 with nozzles 74 facing tube bundle 12. Air cylinder 60 is actuated to cause first frame section 46*a* to pivot from its first installation position to its second locked operating position. Air cylinder 68 is then actuated to cause sprocket 64 and motor 62 to move from a first inoperative position to a second operative position wherein sprocket 64 engages chain 40 on track 28. Motor 48 is actuated to cause rotation of sprocket 64 and driving of carriage 30 along track 28 while high pressure cleaning fluid is supplied through fluid supply line 82 to nozzle block 72 and nozzles 74 for sludge removal from tubes 13. After the tubes exposed by the two windows 20 have been cleaned, track 28 may be manually repositioned so that tubes exposed by a third window may be cleaned. Naturally, separate carriage assemblies utilizing nozzles 74 aimed at different angles may be used at each window 20 as the access angle of tubes 13** varies from one window to the next.

As an alternative, a nozzle block which tilts up and down rather than changing elevations may be provided. A nozzle block may also be provided which can be angled from side to side to aid in jet alignment. An alternate drive means may also be provided such as one with a movable track chain and a fixed sprocket on the carriage assembly.

Because many varying and differing embodiments may be made within the scope of the invention concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a once-through steam generator having a tube bundle with an open tube lane extending one-half way through the tube bundle, a lower tube sheet, a circular shroud surrounding the tube bundle and having a plurality of window openings evenly spaced therearound substantially at the level of the lower tube sheet, an outer shell having a manway opposite the open tube lane, and a lance assembly, said lance assembly comprising:

a. a track having at least two sections removably positioned on said lower tube sheet substantially opposite said open tube lane;

b. a carriage assembly movably received on said track;

c. drive means mounted on said track and carriage assembly for causing movement of said carriage along said track;

d. a nozzle block movably mounted on said carriage assembly and adapted for vertical movement of said block relative to said carriage assembly; and e. a plurality of nozzles mounted on said nozzle block for delivering high pressure fluid toward said tube bundle.

2. The lance assembly of claim 1, wherein said drive means comprises:

a. a chain mounted on said track;

b. a drive motor mounted on said carriage assembly;

c. a sprocket attached to said drive motor and mounted in said carriage assembly so as to contact said chain and cause movement of said carriage in response to rotation of said sprocket.

3. In a once-through steam generator having a tube bundle with an open tube lane extending one-half way through the tube bundle, a lower tube sheet, a circular shroud surrounding the tube bundle and having a plurality of window openings evenly spaced therearound substantially at the level of the lower tube sheet, an outer shell having a manway opposite the open tube lane, and a lance assembly, said lance assembly comprising:

a. a track having at least two sections removably positioned on said lower tube sheet substantially opposite said open tube lane;

b. a chain mounted on said track;

c. a carriage assembly movably received on said track;

d. a drive motor mounted on said carriage assembly;

e. a sprocket attached to said drive motor and mounted in said carriage assembly so as to contact said chain and cause movement of said carriage in response to rotation of said spracket;

f. a nozzle block movably mounted on said carriage assembly and adapted for vertical movement of said nozzle block relative to said carriage assembly; and g. a plurality of nozzles mounted on said nozzle block for delivering high pressure fluid toward said tube bundle.

* * * * *